US008297455B2

(12) United States Patent
Smyth

(10) Patent No.: US 8,297,455 B2
(45) Date of Patent: Oct. 30, 2012

(54) KNUCKLE FOR A RAILWAY CAR COUPLER

(75) Inventor: Andrew Smyth, Hoboken, NJ (US)

(73) Assignee: Strato, Inc., Piscataway, NJ (US)

( * ) Notice: Subject to any disclaimer, the term of this patent is extended or adjusted under 35 U.S.C. 154(b) by 285 days.

(21) Appl. No.: 12/563,633

(22) Filed: Sep. 21, 2009

(65) Prior Publication Data

US 2011/0068077 A1 Mar. 24, 2011

(51) Int. Cl.
*B61G 3/00* (2006.01)

(52) U.S. Cl. ..... 213/155; 213/100 R; 213/75 R

(58) Field of Classification Search ..... 213/100 R, 213/104, 109, 113, 114, 115, 118, 152, 153
See application file for complete search history.

(56) References Cited

U.S. PATENT DOCUMENTS

| | | | | | |
|---|---|---|---|---|---|
| 3,996,991 | A | | 12/1976 | Ugata et al. | |
| 4,170,256 | A | | 10/1979 | Blazek et al. | |
| 4,502,525 | A | | 3/1985 | Oshinsky | |
| 4,605,133 | A | * | 8/1986 | Altherr | 213/155 |
| 4,976,363 | A | | 12/1990 | Altherr | 213/155 |
| 4,984,696 | A | | 1/1991 | Altherr | 213/151 |
| 5,050,751 | A | | 9/1991 | Thrift et al. | 213/111 |
| 5,285,911 | A | | 2/1994 | Altherr | 213/152 |
| 5,312,007 | A | | 5/1994 | Kaufhold et al. | 213/75 R |
| 5,582,307 | A | * | 12/1996 | Hawthorne et al. | 213/109 |
| 5,954,212 | A | * | 9/1999 | Beatty et al. | 213/155 |
| 6,129,227 | A | * | 10/2000 | Openchowski et al. | 213/111 |
| 6,148,733 | A | * | 11/2000 | Gagliardino | 213/154 |
| 6,206,215 | B1 | | 3/2001 | Maa | 213/75 R |
| 6,290,079 | B1 | | 9/2001 | Altherr | 213/1.3 |
| 6,360,906 | B1 | | 3/2002 | Kaufhold et al. | 213/75 R |
| 6,427,759 | B1 | | 8/2002 | Bauer et al. | |
| 7,055,705 | B2 | | 6/2006 | Sprave | 213/20 |
| 7,302,994 | B2 | | 12/2007 | Mautino et al. | 164/137 |
| 7,337,826 | B2 | | 3/2008 | Mautino et al. | 164/137 |
| 7,497,345 | B2 | * | 3/2009 | Brabb et al. | 213/100 R |
| 7,757,871 | B2 | * | 7/2010 | Mautino et al. | 213/154 |
| 7,926,672 | B2 | | 4/2011 | Ely | |
| 2003/0127412 | A1 | | 7/2003 | Mautino et al. | 213/75 R |
| 2005/0011852 | A1 | | 1/2005 | Fetterolf et al. | 213/75 R |
| 2005/0184021 | A1 | * | 8/2005 | Mautino et al. | 213/118 |
| 2007/0084818 | A1 | * | 4/2007 | Brabb et al. | 213/100 R |
| 2008/0083690 | A1 | * | 4/2008 | Mautino et al. | 213/152 |
| 2008/0128377 | A1 | * | 6/2008 | Mautino et al. | 213/75 R |
| 2009/0294395 | A1 | * | 12/2009 | Smerecky | 213/155 |
| 2010/0326943 | A1 | * | 12/2010 | Mautino et al. | 213/100 R |
| 2011/0068077 | A1 | * | 3/2011 | Smyth | 213/155 |
| 2011/0163059 | A1 | * | 7/2011 | Gagliardino et al. | 213/100 R |

OTHER PUBLICATIONS

AAR Manual of Standards and Recommended Practices, Coupler and Yoke Details, S-106 (2007), and S-117 (2007); Casting Details, M-211 (2007), and M-216 (Draft).

International Search Report and Written Opinion Issued in Corresponding Application No. PCT/US2010/46325, Dated May 31 2012—12 pages.

* cited by examiner

*Primary Examiner* — Jason C Smith
(74) *Attorney, Agent, or Firm* — Brendan Mee Law, P.C.

(57) ABSTRACT

A knuckle for a railway coupler system is made without internal voids or cores. Instead, external pockets are formed on the front face and tail portion surface to reduce weight. The knuckle is formed by investment casting, which permits a pulling face to be provided without a draft angle or parting line typical of a cast part. As a result of these innovations, the knuckle according to the invention has an improved fatigue life.

12 Claims, 1 Drawing Sheet

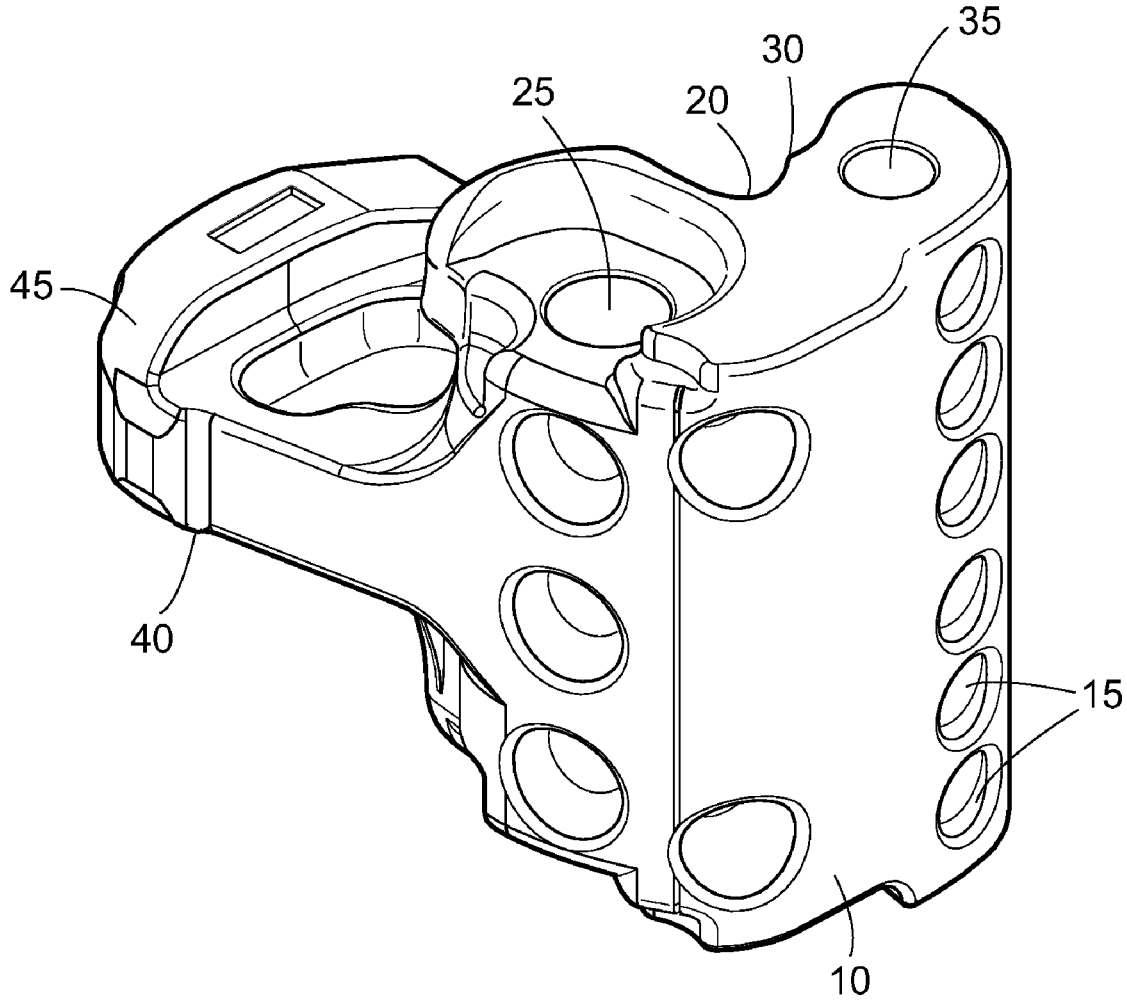
35
30
25
20
45
40
15
10

KNUCKLE FOR A RAILWAY CAR COUPLER

BACKGROUND OF THE INVENTION

1. Field of the Invention

The invention is in the field of coupler systems for railway cars, and in particular, the invention is directed to a novel knuckle, adapted to engage with American Association of Railroads ("AAR") type E and type F couplers.

2. Description of Related Art

In a railway car coupler system, the knuckle element is the final point of contact between two railway cars, and the most prone to failure. In some sense, the knuckle is designed to fail; because if any element in the coupler system is to fail, it should be the lightest and most accessible element, which is the knuckle. However, given the constraints of size, shape and weight, it is still desirable that a knuckle should be made as resistant to fatigue and failure as possible. Knuckle failure accounts for an estimated 11,000 train separations a year, or about 30 separations per day.

Conventionally, a knuckle weighs approximately 78 to 88 pounds. However, a solid metal object this size, would weigh much more than the standard weight—upwards of 100 lbs. Therefore, conventionally, knuckles have been designed to contain internal voids to reduce the total weight, using a "core" in the casting process to create the internal void. For example, U.S. Pat. No. 7,337,826 B2 discloses and claims a method of using a core to obtain a cast knuckle having an internal void. One evident problem with the core method is that it produces inconsistent results. The core cannot be seen during the casting process, and it can move, causing the position of the internal voids and the internal wall thickness vary significantly in the finished products, with the result that the average fatigue life of knuckles is not consistent. This has led to a drive by the AAR to create fatigue life standards, as described below.

It has been discovered that relatively small point to point contact surfaces of the engaged portions of knuckles in a coupler system can cause premature failure due to stress risers being established within the knuckle. The inventor herein has recognized, based on industry studies and research, that these failures originate in the casting process, for example where the mold shifts along the parting line and a detrimental point to point surface contact is established in the finished knuckle. Grinding and/or machining of such imperfect surface after heat treatment can add substantially increased costs and creates crack initiation sites on the surface, thereby adding stress to the coupler knuckle and potentially resulting in premature and unpredictable knuckle failure.

Another reason for knuckle failure is the draft angles which are generally required in order to produce a satisfactory sand casting. Typically, a mold cavity is made using a pattern which has slight draft angles, often in a range of about 2 degrees to 3 degrees, in order to allow the pattern to be withdrawn from the mold cavity. Without the draft angles, withdrawing the pattern from the mold cavity can result in the sidewalls partially collapsing or otherwise deforming. However the draft angle yields a non-uniform contact surface area on the pulling face of the finished product. The present invention discloses an improved knuckle with improved contact surface engagement with other knuckles by virtue of having no draft angle. The invention herein provides a cast knuckle made without internal voids and without using cores, which still achieves the standard weight and has improved average fatigue life. A casting according to the present invention has no parting line caused by the meeting point of two mold halves.

Another inherent problem with the sand casing process is the porosity caused by moisture. In the sand casting process, moisture is required to hold the sand together. When the molten metal is poured into the mold, the moisture flashes to steam and may produce internal and surface porosity in the finished product.

SUMMARY OF THE INVENTION

A knuckle for a railway car coupler system of the present invention comprises: a front portion comprising a front face generally opposite a pulling face; a cast utility hole extending into a top surface of the knuckle; a pivot pin hole extending from a top surface of the knuckle to a bottom surface of the knuckle; and a tail portion. The knuckle is free of internal voids and its front portion has a plurality of ribs defining front external weight reduction pockets. The tail portion has a second plurality of ribs defining rear external weight reduction pockets. The total weight of the knuckle is in a range of about 75 to about 90 lbs. Further, the knuckle of the present invention is produced by investment casting to create a smoother pulling face, free of parting lines and/or draft angles.

The invention is also embodied as a method for increasing fatigue life in a knuckle by using investment casting. The method comprises: forming a destructible prototype of the knuckle as defined above. Thus, the prototype has a pulling face and includes a plurality of ribs defining front external weight reduction pockets and a plurality of ribs defining rear external weight reduction pockets, such that no draft angle is provided to the pulling face. The destructible prototype is coated with a semi-permanent ceramic-type coating to form a temporary mold. The destructible prototype is removed/destroyed, followed by casting a finished knuckle in the temporary mold, followed by destroying the temporary mold. A knuckle made according to this method has a weight in a range of about 75 lbs to about 90 lbs (preferably in a range of about 80 lbs to about 85 lbs). Preferably, a knuckle made by the inventive process has an average fatigue life as determined by standard M-216 of at least 600,000 cycles, and a minimum fatigue life of at least 400,000 cycles, as determined by the same standard.

A knuckle made using the investment casting process has reduced porosity because moisture is not required to hold the mold together, and the temporary mold may even be preheated prior to pouring in molten metal. These factors, in conjunction with the ceramic mold finish, contribute to a surface finish having a surface roughness less than 300 microinches (RMS), and preferably in a range of about 120 to 200 microinches (RMS).

BRIEF DESCRIPTION OF THE DRAWINGS

FIG. 1 is a perspective view of a knuckle according to the invention.

DETAILED DESCRIPTION OF THE INVENTION

As used herein, directions are relative to the normal orientation of a railway car. Thus, "horizontal" means generally parallel to the earth, and vertical is the perpendicular direction. The words "forward" and "front" refer to the direction away from the railway car, while "tail" and "rear" refer to the opposite direction. This means that the "front" ends of two coupler systems on adjacent railway cars face each other, in opposition directions. "E-type" and "F-type" are used to refer to types of coupler head generally, without reference to the details of a particular AAR standard. One of ordinary skill in the art will readily understand that a knuckle according to the invention may be for attachment to an "E-type" coupler head, even though the coupler may depart slightly from one or more AAR standards. Relative vertical motion between two F-type couplers is eliminated by interlocking features on the coupler head which are not present on the E-type coupler head. Although the knuckles have slightly different geometry, in all material structural respects, the two are identical. Where reference is made herein to a specific AAR standard, the reference is to the AAR standard in effect at the time of filing of this application. Where specific dimensions are given in the present description, it will be understood that tolerances are permitted. One of ordinary skill in the art will understand that a given dimension of less than 4 inches is typically permitted a tolerance of about ±1/16 inches; a dimension of 4 inches to 24 inches is typically permitted a tolerance of about ±3/32 inches; and a dimension of more than 24 inches is typically permitted a tolerance of about ±1/8 inch.

According to the invention, a knuckle is preferably made by forming a destructible prototype of the component in a destructible media, for example in wax, expanded foam plastic, or other destructible plastic, which is destroyed after a single use. The prototype is coated with a semi-permanent coating, for example a ceramic slurry, that hardens to form a temporary shell around the prototype. The temporary shell is built up with several layers. The prototype is then removed from the temporary shell leaving a cavity within the shell with an opening called a gate. For example, when the prototype is made of wax, the wax may be melted and removed leaving a cavity within the temporary shell. The shell may be preheated to eliminate moisture. This step may be conducted at 400° F., for example. The component may be then be cast in the shell by pouring in steel or other suitable high tensile strength metal through the gate. After solidification of the metal, the shell is broken and removed.

The particular advantage of investment casting in this context, compared to the conventional "green sand" method, is that there is no parting line formed between sides of a mold, as in the conventional method. Also, it is not required to provide a draft angle so that the mold can be removed from the cast knuckle. The resulting article has better dimensional tolerances, such as within ±3% of a design dimension, with reduced need for chiseling or finish grinding, especially at the parting line area. Studies have shown that this area of the knuckle is where defects leading to failure generally form. Many of the features of the knuckle, including the exterior weight reduction pockets, are made possible by the novel application of the investment casting process. In many cases, the investment cast coupling components have a smooth surface finish, without requiring any finish grinding, so that overall they are more aesthetically appealing than prior art designs.

A knuckle produced using investment casting may be produced at a standard weight of 78 lbs to 88 lbs, without internal voids, and still meet or exceed the standards set forth in AAR Manual of Standards and Recommended Practices Casting M-216 and M-211, incorporated herein by reference.

According to standard M-211, a knuckle according to the invention withstands a minimum ultimate tension of 650,000 lbs in a static tension test.

The M-216 standard reflects a fatigue life, under cycling of loads. According to the M-216 standard, an approved machine is used to input a draft (tensile) load to a knuckle through an AAR approved standard production coupler body. Test input loads are sinusoidal and are applied in a series of segments having a minimum and a maximum load range. The segments, which are described in the standard, are repeated until failure occurs. To meet the M-216 standard, four knuckles tested according must exhibit an average life of at least 600,000 cycles, and no individual knuckle may exhibit a life below 400,000 cycles.

As seen in FIG. 1, a knuckle for a railway car coupler system of the present invention includes a front portion 30 having a front face 10 generally opposite a pulling face 20. A pivot pin hole 25 extends from a top surface of the knuckle to a bottom surface of the knuckle and is located generally between the front portion 30 and the tail portion 40. A cast utility hole 35 extends into a top surface of the knuckle (for placement of a flag, for example). In a preferred embodiment, the cast utility hole extends through to a bottom surface of the knuckle. The knuckle is free of internal voids, and the front portion 30 includes a plurality of ribs defining front external weight reduction pockets 15, and said tail portion 40 comprises a second plurality of ribs defining rear external weight reduction pockets 45 (not visible in this view).

The pockets are located at points on the front portion and tail portion of the knuckle such that certain load bearing areas remain solid and robust. Thus, the pulling surface is of course an uninterrupted surface. A front face surface 10 between the pivot pin hole and the cast utility hole 35 is provided that is also uninterrupted by pockets. Surface 10 is maintained as structurally robust as possible, as this area is prone to impact with a coupler head or knuckle of an adjacent railway car. The novel weight reduction pockets according to the invention preferably form a closed geometric shape, such as a square, triangle, or the circles shown in FIG. 1. The volume of a pocket is measured from the rim of the pocket. Substantially all of the weight reduction obtained with the novel design of the invention is from the use of these pockets formed on the peripheral surface of the knuckle. The volume of the pockets cumulatively is at least 23 $in^3$ and may be as much as 131 $in^3$, resulting in a weight reduction of at least 7 lbs up to 37 lbs. Preferably the volume of the pockets cumulatively is in a range of about 50 $in^3$ to about 70 $in^3$, accounting for a savings of about 15 lbs to about 20 lbs of cast steel. The placement of the weight reduction pockets is selected so as not to cause interference with features on the coupler head, such as the interlocking features of an F-type coupler head, and also to locate stress risers in non-critical areas.

Finite element analysis software was used to determined the most highly stressed areas under application of draft (tensile) loads, and the pockets were placed to maintain a stress level as reasonably close to a "solid" knuckle as possible. The pockets are sized and numbered such that the resulting knuckle has a weight in a range of 75 lbs to 90 lbs, more preferably 78 lbs to 88 lbs, and most preferably in a range of about 80 lbs to about 85 lbs.

Investment casting techniques may be used to prepare an E type knuckle or an F type knuckle within the scope of the invention. The outside dimensions of a "standard" knuckle has not been completely characterized in a published AAR standard. However, the contour and detail of the pivot pin hole for an E type knuckle is described in AAR Standard S-106, and the contour of an interlocking F type knuckle is described in AAR Standard S-117. The hub height, for example, from the pivot pin hole 25 on the top surface to a corresponding hole on the bottom surface, is the same for every knuckle. In preferred embodiments, the knuckles prepared according to the invention meet these standards, notwithstanding the presence of the weight reduction pockets Surface roughness is measured using a comparator plate and may be characterized with various statistical values related to the valley-to-peak height on the surface. The rootmean-square (RMS) value used herein is well known to those of ordinary skill in the art. Whereas sand cast parts typically have an RMS surface roughness in a range of 300 to 420 microinches, the investment cast knuckle according to embodiments of the invention preferably has a surface roughness of less than 300 microinches (RMS), and more preferably in a range of about 120 to about 200 microinches (RMS). It is believed that reduced porosity results in a smoother surface, although reduced porosity is not the only factor leading to the improved surface finish. The ceramic temporary mold (as opposed to a packed sand mold) also contributes to the lack of surface porosity.

The proposed fatigue life standards described above do not reference outside dimensions, or for that matter inside dimensions (if a core is used to reduce the weight of the casting). In order to perform comparative testing, an electronic "master gage" was prepared using a laser scanning process to represent a standard knuckle. A solid knuckle of cast steel meeting the "standard" dimensions weighed about 103.4 lbs, whereas a preferred knuckle according to the invention weighs 85.2 lbs, a weight reduction of about 18%. Laser scanning and the preparation of a "master gage" may also be used to ensure that the positions of pockets of the inventive casting are located such that their position will not cause interference with other elements of the coupler system.

In another novel embodiment, residual compressive stresses are created on the pulling face of the inventive knuckle by shot peening the pulling face surface after the casting is made. Shot peening involves impacting the surface with small spherical media, projected at high speeds. This process counteracts the tensile stresses that are applied during use that tend to cause crack initiation. This increases fatigue life and performance without increasing the overall strength of materials or of the part.

What is claimed is:

1. A knuckle for a railway car coupler system, comprising:

a front portion comprising a front face generally opposite a pulling face;

a cast utility hole in a top surface of the knuckle;

a pivot pin hole extending from a top surface of the knuckle to a bottom surface of the knuckle;

a tail portion;

wherein said pivot pin hole is located generally between the front portion and the tail portion;

wherein said knuckle is free of internal voids, said front portion comprises a plurality of ribs defining front external weight reduction pockets, and said tail portion comprises a second plurality of ribs defining rear external weight reduction pockets; and wherein a total weight of the knuckle is in a range of about 75 to about 90 lbs.

2. The knuckle according to claim 1, wherein the weight of the knuckle is in a range of about 78 lbs to about 88 lbs.

3. The knuckle according to claim 1, wherein the knuckle is adapted for connection to an E type coupler.

4. The knuckle according to claim 1, wherein the knuckle is adapted for connection to an F type coupler.

5. The knuckle according to claim 1, wherein the pulling face does not have a draft angle.

6. The knuckle according to claim 1, wherein the pulling face is free of any parting line.

7. The knuckle according to claim 1, wherein the pulling face has a shot-peened surface.

8. The knuckle according to claim 1, having smooth surfaces formed by investment casting.

9. The knuckle according to claim 1, wherein a volume defined by the weight reduction pockets cumulatively is in a range of about 50 $in^3$ to about 70 $in^3$.

10. The knuckle according to claim 1, wherein the finished knuckle has a minimum average life of 600,000 cycles, as determined by standard M-216.

11. The knuckle according to claim 1, wherein the finished knuckle has a minimum life of 400,000 cycles, as determined by standard M-216.

12. The knuckle according to claim 1, having a surface finished characterized by a surface roughness in a range of about 120 microinches (RMS) to about 200 microinches (RMS).

* * * * *